US005775144A

United States Patent [19]

Pagalday

[11] Patent Number: 5,775,144

[45] Date of Patent: Jul. 7, 1998

[54] SYSTEM OF NON-REPRODUCIBLE LOCKING KEY AND CYLINDER FOR SAID KEY

[76] Inventor: Jose Ignacio Pagalday, Avda. de Tolosa, 77 20009 San Sebastian (Guipuzcoa), Spain

[21] Appl. No.: 595,731

[22] Filed: Feb. 2, 1996

[30] Foreign Application Priority Data

Aug. 2, 1995 [ES] Spain ..... 9501573

[51] Int. Cl.[6] ..... E05B 27/06

[52] U.S. Cl. ..... 70/358; 70/399; 70/493; 70/395

[58] Field of Search ..... 70/358, 369, 387, 70/395, 399, 405, 406, 409, 419, 375, 493

[56] References Cited

U.S. PATENT DOCUMENTS

| | | | |
|---|---|---|---|
| 485,724 | 11/1892 | Toops | 70/399 |
| 1,382,826 | 6/1921 | Dove | 70/493 |
| 1,567,979 | 12/1925 | Northrop | 70/399 |
| 1,735,868 | 11/1929 | Klingel | 70/DIG. 37 |
| 3,877,267 | 4/1975 | Harris, Jr. | 70/358 |
| 4,377,082 | 3/1983 | Wolter | 70/409 |
| 4,771,620 | 9/1988 | Kleinhany | 70/358 |
| 5,086,632 | 2/1992 | Hsu | 70/399 |
| 5,170,651 | 12/1992 | Errani | 70/395 |
| 5,533,369 | 7/1996 | Valdajos-Gallego | 70/395 |

FOREIGN PATENT DOCUMENTS

| | | | |
|---|---|---|---|
| 472495 | 2/1992 | European Pat. Off. | 70/358 |

*Primary Examiner*—Darnell M. Boucher
*Attorney, Agent, or Firm*—Laff, Whitsel, Conte & Saret, Ltd.

[57] ABSTRACT

A system of non-reproducible locking key and cylinder for said key, which being a flat-blade type key (1) has installed a lengthwise swinging member (6) with the capacity of realizing two combined rotary movements of limited width, which are: a first perpendicular transverse movement at the bottom of said flat blade (1), a second angular sweep rotary movement which takes place in the direction of the width of said blade, movements which are produced respectively with relation to a first (*7a*, *7b*) and second (8) axes. The swinging member (6) being located in a sectorial window (9) which runs through the thickness of the key, forming radial lateral sidewalls (*9c*) which extend divergently between a relatively narrower front wall (*9b*) located adjacent the entering end of key (1), and a relatively wider arched rear wall (*9c*) in opposition thereto.

23 Claims, 5 Drawing Sheets

15
16
17
1
2
5
6
7a, 7b
18
25
26
27
28
29
30
31
35
36
37
38
39
42
43
44
45
46
47
48
49
48, 49

SYSTEM OF NON-REPRODUCIBLE LOCKING KEY AND CYLINDER FOR SAID KEY

SCOPE OF THE INVENTION

The closures to which the invention refers are those in which the combination or code for opening is established within an assembly consisting of a retaining ring within which there is able to rotate a cylinder incorporating an insertion channel for a flat key blade. In this blade there exist tracks of diverse configuration which are acted upon by pins which are impelled by corresponding counterpins mounted against a spring; in such a way that when the correct key is inserted, the contact in each set of pin-counterpin is produced precisely on the cylinder of separation between the rotary cylinder and the enveloping retaining ring, there being thus established the principal code for the opening of the closure.

In particular, the object of the invention is to determine a system of key and corresponding cylinder incorporating means considered as non-reproducible outside the process of manufacture, which make it possible to establish an opening code that is in addition to said principal code and which we shall designate hereinafter as the secondary code. So that if the principal code has been falsified, the rotary blockage of the cylinder will remain secured by these non-reproducible means.

From the following description it will be seen that the invention is applicable with equal efficiency whether the tracks of the principal code are engraved into the faces of the flat blade ("flat" key) or are in the edge of this blade ("toothed" key).

STATE OF PRIOR ART

In relation to this invention, there are known non-reproducible key-cylinder systems which are based on the fact that the key blade incorporates some moving element which, combining its form and mobility, makes it possible to establish the secondary opening code.

Until now, the various known systems coincide in that the movable element possesses a single degree of freedom or movement, whether of rotation or displacement, and whether or not it is conditioned by some impelling spring. Given the available dimensions of a key, the amount of the movement is necessarily limited and, furthermore, the sole displacement of the movable element also activates a sole locking movement; consequently, the resistance of these systems to a forced opening proves very limited, there being excessively frequent the openings obtained by means of keys which have a correct cutting of the principal code and which, however, lack the movable element of non-reproducibility.

EXPLANATION OF THE INVENTION AND ITS ADVANTAGES

The new key-cylinder system proposed is such that on the flat blade key there is installed a lengthwise swinging member with the capacity to carry out two combined rotary movements of limited breadth, which are a first transverse rotary movement along an axis perpendicular to the plane of said flat blade key, and a second rotary movement of an angular sweep which takes place along a second axis in the direction of the width of said flat blade key, and which transverse and angular rotary movements are produced with relation to the respective first and second axes, said first axis includes a pin which is in the middle plane of the blade key and extending in a perpendicular manner between both lengthwise edges of this blade key, and said second axis being a imaginary geometric one perpendicular to the plane of the blade key and perpendicular to the mid-point of said shaft; said swinging member being installed in a window which passes through the thickness of said blade key, which window has the form of a segment of a circle which is centrally located and extends backwards away from the adjacent entry point of said blade key. The segment configuration forms radially extending lateral sidewalls which extend, divergingly between a relatively narrow front wall and an relatively wider arched rear wall.

The combining capacity of said two rotary movements makes it possible for the validating position of the swinging member to be determined by three sets of pin-counterpin locking; in other words, the swinging member will act on said three locking sets, which is equivalent to tripling the resistance to attempts at forced entry with said keys that are correct in their principal code, but that lack this mechanism of non-reproducibility. (As seen in FIG. 7). This is the principal code.

Thus, in accordance with the invention, said swinging member has an operative cross-section with respect to which there operates simultaneously a fixed pin and three sets of pin-counterpin locking sets comprising first, second and third movable pins which are impelled by the respective first, second and third counterpins, all of these counterpins being precisely retractable in said static body against the respective first, second and third springs, when between said operative cross-section of said swinging member and said fixed first, second and third fixed and movable pins, there is established a secondary opening code which is in addition to said principal opening code relative to said tracks in the key blade.

Specifically, said operative cross-section is configured with and essentially rectangular shape which shape, with respect to said key blade in horizontal position, is defined by first and second vertical sides, which are transverse to the plane of said key blade, and by first upper and second lower curvoconvex horizontally disposed wall, all of them such that when the secondary opening code is determined: said first vertical side receives from said fixed pin a lateral positioning action producing an angular rotation of said swinging member, with respect to said second vertical axis; said second vertical side rests against a corresponding one of said sidewall of said radial window, due to the lateral action by the fixed pin. The first horizontal lower wall acts on and operates said first movable pin. The upper horizontal wall moves and operates said second and third movable pins. This assumes that, when the fixed pin determines the rotated position of the second axis defined between this fixed pin itself and one of the angular radial window sidewalls, it happens that the third pin-counterpin set operates with respect to this position, while the position of the swinging member with respect to the first axis of rotation is defined between the first and second pin-counterpin sets which act in opposition on the respective one of said bottom and top horizontal sides. (As seen in the drawing)

An outstanding characteristic of the invention is the self-limiting of both rotary movements, which ensures that the swinging member remains within such margins that it will never move so close to the window that it could become caught in the rotary turning movement of the cylinder or when the key is being withdrawn therefrom. Therefore, this invention may be applied both to "flat" keys which have the tracks in the lateral sides of the blade (these keys are generally inserted with the blade in a horizontal position), and to "toothed" keys which have the tracks on the edge of the blade (usually being inserted with the blade in a vertical position).

Another important advantage of the invention is that it has been possible to incorporate it within all the various models of lock assemblies existing on the market.

DRAWINGS AND REFERENCES

In order to have a better understanding of the nature of the present invention, we have, in the attached drawings, represented a preferred form of industrial realization, which has the character of a merely illustrative and non-limitative example.

Figure 3:
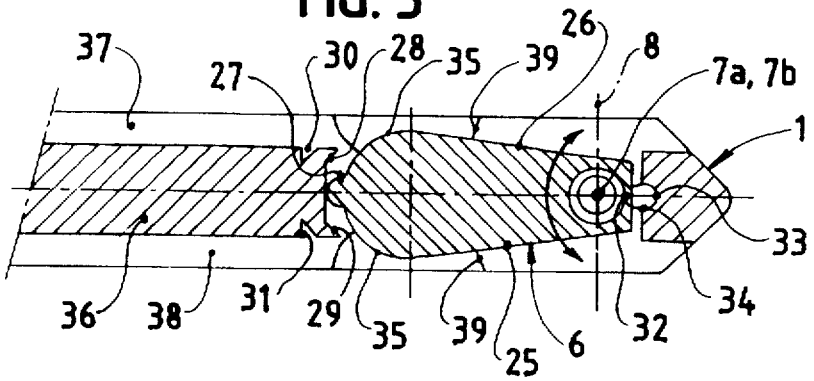
FIG. 3 is a sectional view taken along line 3—3 shown in FIG. 2.
Figures 7, 8, 9, 10, 11, 12, 13:
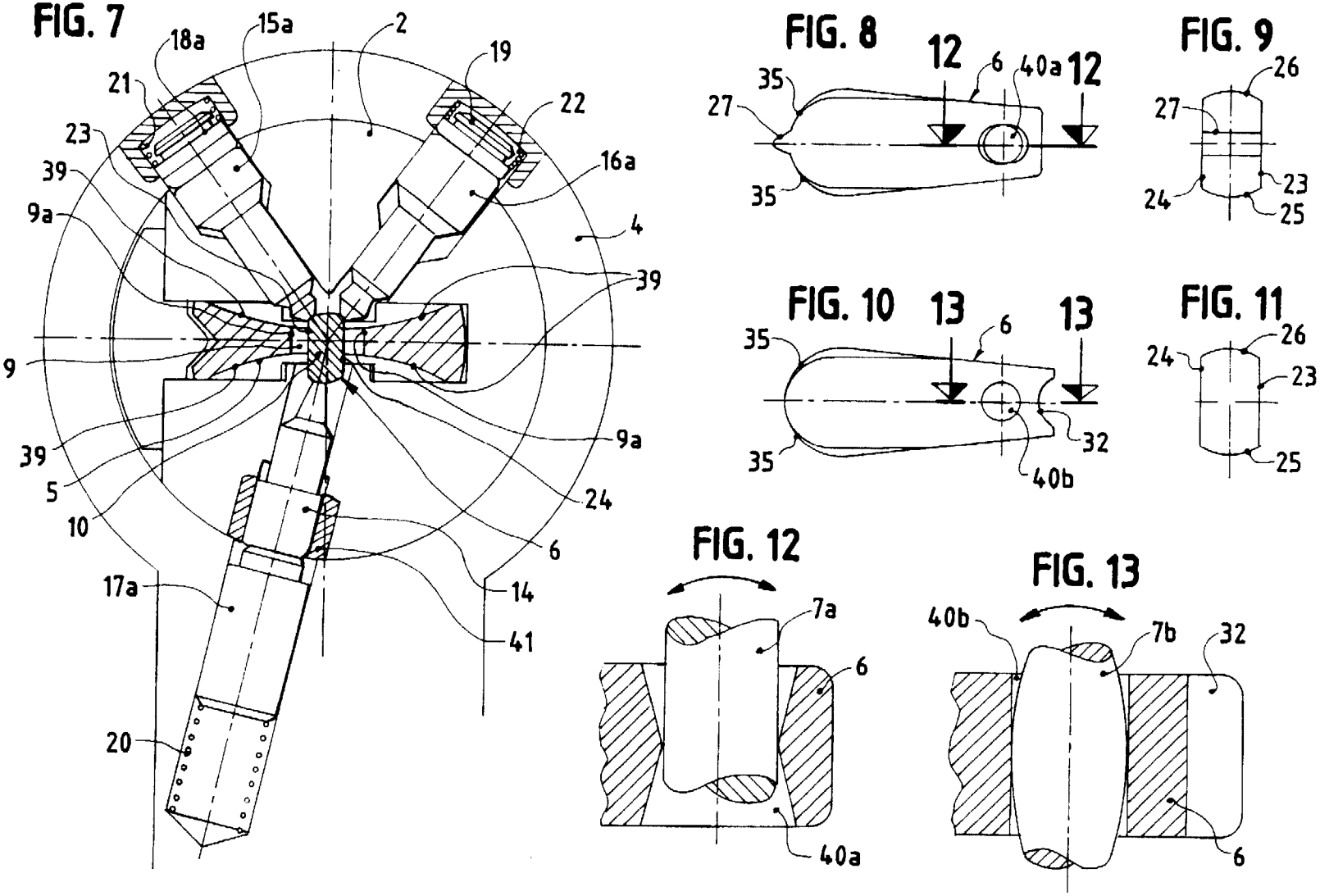
FIG. 7 is another embodiment similar to the previous FIGS. 5 and 6, but shows the state of blockage caused by the same key blade (1) of FIG. 6 when the fixed pin (11) is not installed; (this is an embodiment of the principal code)
FIGS. 8 and 10 are elevational view which correspond to two possible embodiments of the swinging member (6), as shown in FIGS. 2 and 3.
Figures 14, 15, 16, 17, 18, 19, 20, 21, 22:
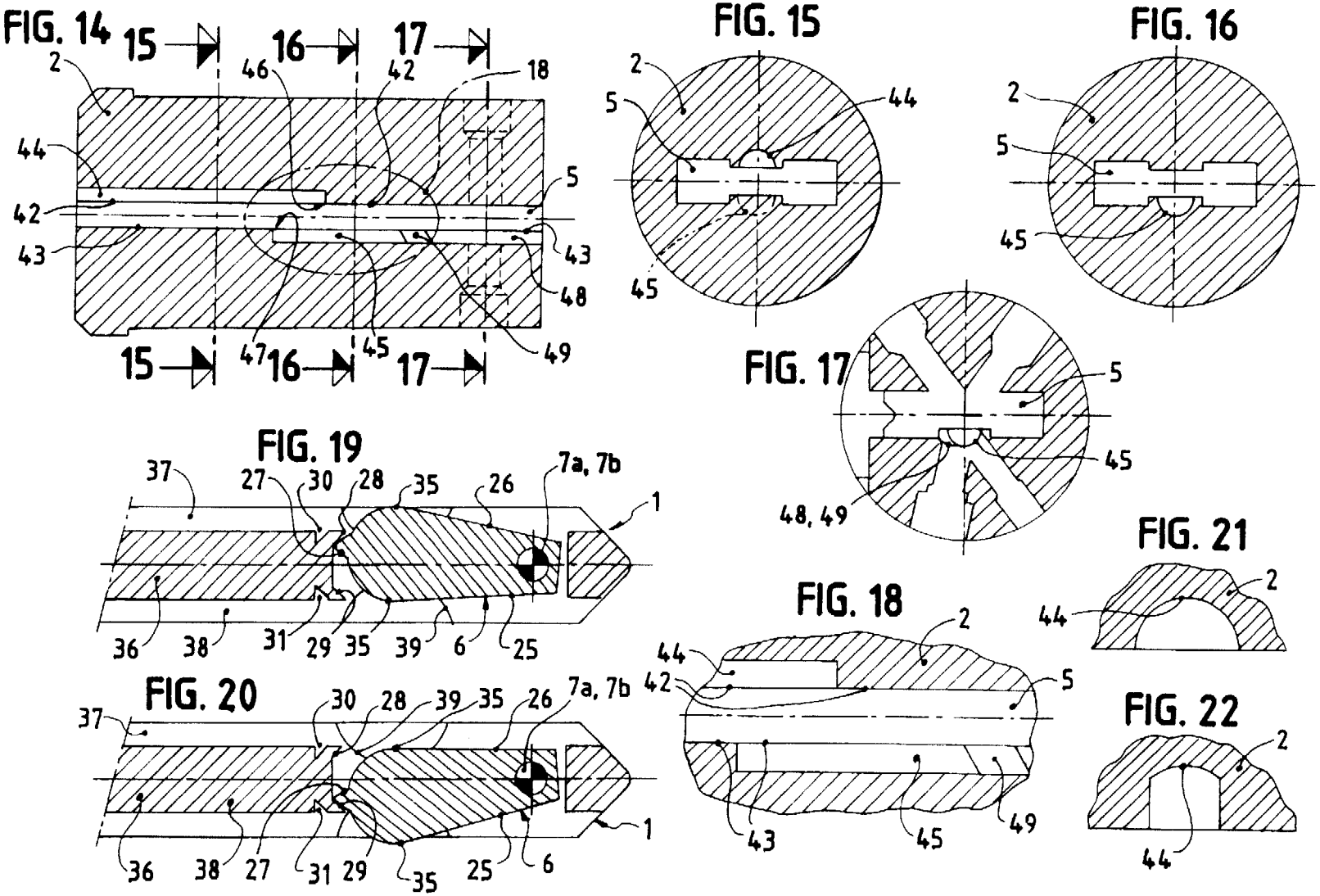

FIGS. 9 and 11 are respective end views corresponding to FIGS. 8 and 10, as viewed from the left end of these FIGS. 8 and 10, respectively;

FIG. 12 shows in larger scale the partial section taken along line 12—12 as seen in FIG. 8;

FIG. 13 is the partial section in larger scale taken along line 13—13 as seen in FIG. 10;

FIG. 14 shows a cylinder (2) according to the invention, cut along its longitudinal median plane perpendicularly to the key channel (5);

FIGS. 15, 16, and 17 show, in enlarged form, the respective cross-sections taken along lines 15—15, 16—16, and 17—17, respectively, in FIG. 14;

FIG. 18 shows, in enlarged format, the encircled area (18) in FIG. 14;

FIGS. 19 and 20 are similar to FIG. 3 but show, respectively, the projection (27) butting against the coined lip (28) and against the second coined lip (29);

FIG. 21 shows, in enlarged form, an embodiment of the shape of the cross-section of the upper (44) and lower (45) grooves employed for FIGS. 15 and 17;

FIG. 22 shows another embodiment of the transverse section of the upper (44) and lower (45) grooves, as an alternative to that in FIG. 21.

Figure 1:
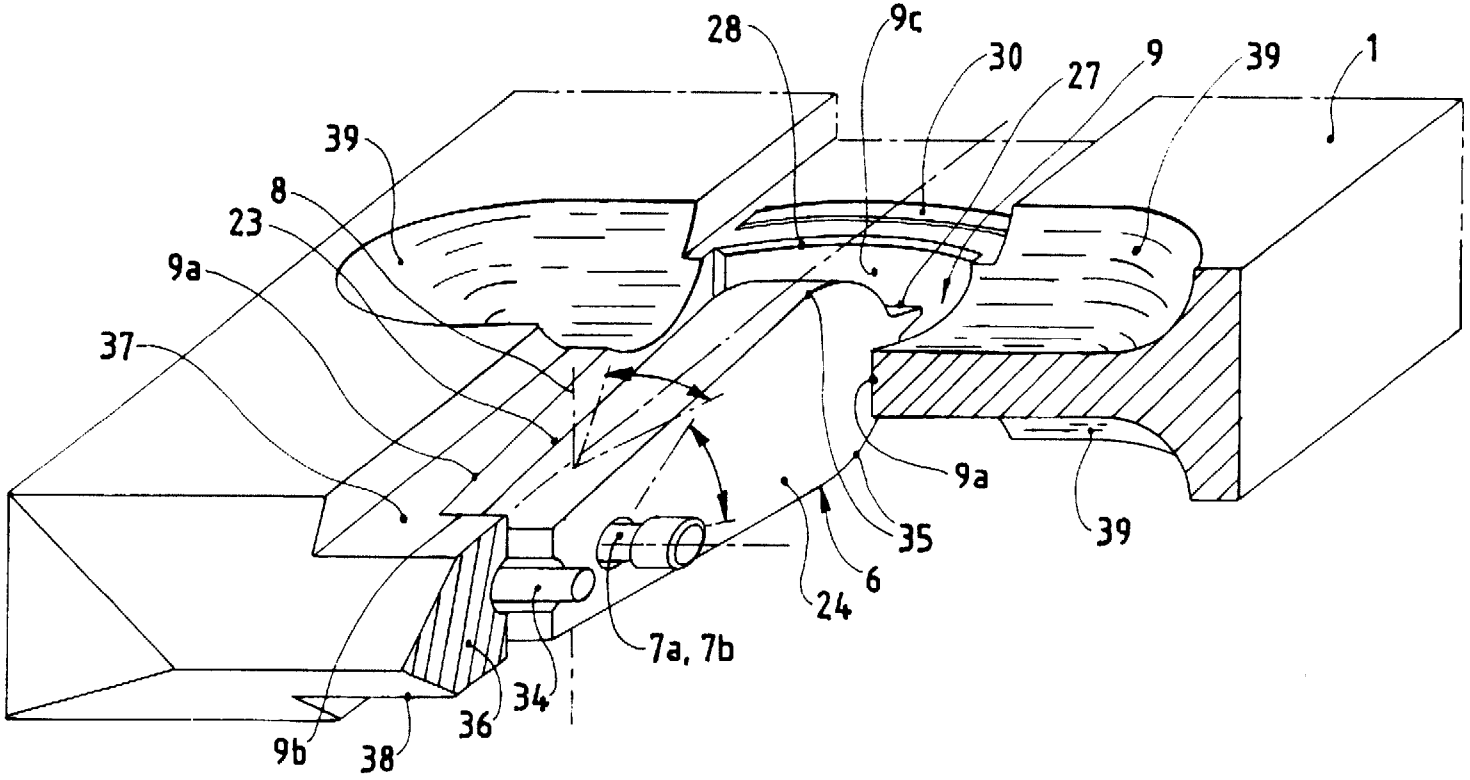
FIG. 1 is a perspective view in partial section which shows a "flat" blade key (1) constituted in accordance with the invention.
Figure 4:
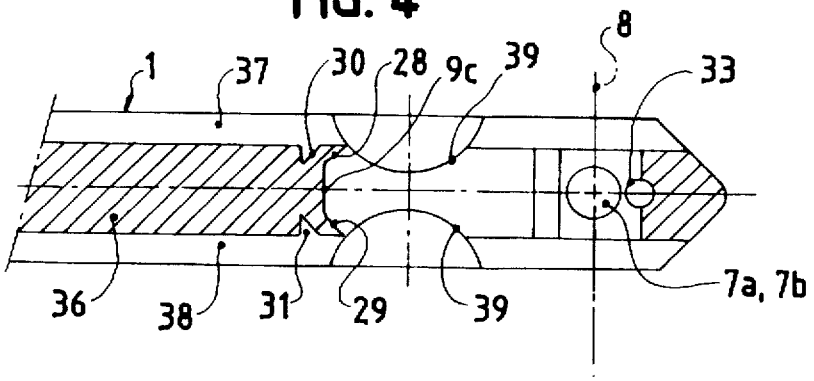
FIG. 4 is the same as FIG. 3, but without the longitudinal swinging member (6) installed.
Figure 2:
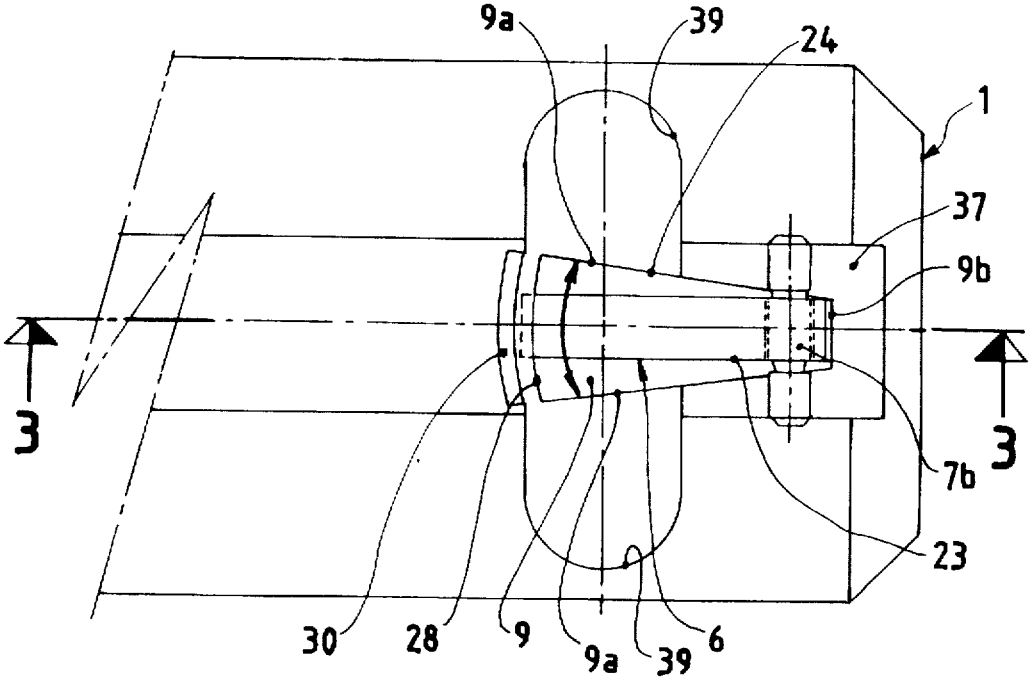
FIG. 2 is a plan view corresponding to FIG. 1.

The following references are indicated in these figures:

1. - Flat blade key
2. - Rotary cylinder
3. - Section along 3—3 in FIG. 2
4. - Holding member (retaining ring)
5. - Key channel
6. - Code defining longitudinal swinging member
7*a*. - First cylindrical shaft
7*b*. - First convex shaft
8. - Second (geometric) axis for rotation
9. - Segmental window
10. - Operative cross-section of swinging member
11. - Fixed pin
12—12. - Section identifier
13—13. - Section identifier
14. - First pin
15—15. - Section identifier
15*a*. - Second pin
16—16. - Section identifier
16*a*. - Third pin
17—17. - Section identifier
17*a*. - First counterpin
18. - Enlarged detail
18*a*. - Second counterpin
19. - Third counterpin
20. - First spring
21. - Second spring
22. - Third spring
23. - First vertical sidewall
24. - Second vertical sidewall
25. - First horizontal sidewall
26. - Second horizontal sidewall
27. - Rear projection
28. - Upper lip flange
29. - Lower lip flange
30. - Upper coined groove
31. - Lower coined groove
32. - First transverse semi-elliptical cut in front wall of swinging member 6
33. - Second cylindrical cut in facing front wall of segmental window
34. - Cylindrical cotter
35. - Curvilinear rear face
36. - Reduced thickness along axis of flat blade
37. - Upper first groove
38. - Lower second groove
39. - Transverse curvoconcave reductions
40*a*. - Bi-ellipsoidal widened orifice
40*b*. - Cylindrical orifice
41. - Steel sleeve
42. - Upper face of main key orifice in rotary cylinder
43. - Lower face of main key orifice in rotary cylinder
44. - Upper longitudinal groove opening through upper face of orifice to accept swinging member 6
45. - Lower longitudinal groove opening through upper face of orifice to accept swinging member 6
46. - Upper edge
47. - Lower edge
48. - Lateral molding
49. - Bevel

DISCLOSURE OF A PREFERRED EMBODIMENT

With regard to the drawing and references enumerated above, there is illustrated in the attached drawings a preferred embodiment and some variations thereof, all of it intended to define a non-reproducible key-cylinder system endowed with the essential characteristics and advantages which have been described previously and which, together with still others, will make themselves manifest in what follows. The explanation refers to a "flat" type key, that is, it has the tracks of the principal opening code cut into the flat faces of its blade (1); but the same is true if it involves a "toothed" key (tracks of the principal code engraved into the edge of the blade.

Essentially, the invention consists in that (FIGS. 1 to 4) the blade key (1) has a segmental window (9) in which the swinging member (6) can rotate combinably according to a transverse rotation of reduced width around (FIG. 3) a first axis (7*a*, 7*b*) according to an angular rotation also of reduced width around (FIG. 3) a second axis (8) which is geometrical and is defined by a special mode of coupling between said first shaft (7*a*, 7*b*) and swinging member (6). The first of these has rotation which develops transversely to the plane of the key blade (1), while the second rotation takes place in the plane itself of the key blade (1) and along the width thereof.

The limitation in extent of the transverse rotation is illustrated under two different versions which may be employed alternately, or both at the same time, as in FIG. 2. The first version consists of the rear projection (27) of the swinging member (6), which butts against the firs (28) and second (29) lip-like flanges which, in this case, have been created by means of the respective first (30) and second (31) coining done in proximity to the arched rear side (9*c*) of the segmental window (9); when the key is to be inserted in horizontal position, the projection (27) will fall due to gravity down to the abutment created by the second flange (29) and, once the inserted key (1) position is achieved and the correct code established within the key channel (5) of the cylinder (2), said projection (27) can occupy any theoretical position between said first (28) and second (29) flanges. The second version consists of placing of the cylindrical locating rod or limiting key (34) in the housing defined between the approximately semi-elliptical vertical front cut of the swinging member (6) and the semi-cylindrical one (33) (FIG. 3) in the front wall (9*b*) of the window (9); the vertical space provided by the semi-elliptical cut (32) in the one bore permits a transverse reduced rotation with respect to the cylindrical rod (34).

The angular rotation with respect to the second geometrical axis (8) is illustrated in two (FIGS. 12 and 13) of the possible versions. One of these versions (FIG. 12) is to install a first cylindrical shaft (7*a*) in a subsidiary orifice (40*a*) which, from its circular central section to its openings forms individual ellipsoidal widenings, keeping the diameter invariable in the direction of said second geometrical axis (8); with the result that the freedom of angular rotation will be solely in the orthogonal plane of this second geometrical axis (8). The other embodiment consists (FIG. 13) of installing a first convex shaft (7*b*) in a cylindrical opening (40*b*).

The amplitude limitation of the angular rotation is determined by resting of the swinging member (6) against one or the other of the radial disposed walls (9*a*) of the window (9).

The free combination of the two versions of limitation of the transverse rotation with the two generating versions of the angular rotation, makes it possible to define a broad range of possible configurations of the swinging member (6) of which FIGS. 8 through 11 illustrate two embodiments.

The key-cylinder assembly system is such that the swinging member (6) of the key has an operative cross-section (10) which is configured with an essentially rectangular shape so that, with respect to said key blade (1) in a horizontal position, the shape is defined by first (23) and second (24) vertical sides, which are perpendicular to the plane of said key blade (1), and by first 25) and second (26) curvoconvex horizontal sides. For its part, the rotating cylinder (2) incorporates a fixed pin (11) and some first (14), second (15*a*) and third (16*a*) movable pins which, when the correct key is inserted into the channel (5), act simultaneously on said operative cross-section (10) so as to establish a secondary opening code which is non-reproducible outside the process of manufacture of the closure, and which is in addition to the aforesaid principal code thereof. The first (14), second (15*a*) and third (16*a*) movable pins are impelled by the respective first (17*a*), second (18*a*) and third (19) counterpins, due to the action of the corresponding first (20), second (21) and third (22) springs; and their simultaneous action with respect to said operative cross-section (10) of the swinging member (6) is such that: said fixed pin (11) exerts on said first vertical side (23) a lateral positioning action which produces an angular rotation of said swinging member (6) with respect to said second geometric axis (8) until said swinging member (6) comes to have its said second vertical side (24) resting in engagement over the respective said radial sidewall (9*a*) of the segmental window (9); said first movable pin (14) pushes against said first horizontal side (25); and said second (15*a*) and third (16*a*) movable pins both push against said second horizontal side (26).

The segmental window (9) is made in a reduced thickness (36) of said key blade (2), which is defined between two equal first (37) and second (38) grooves longitudinally directed beginning from the tapered point of the key blade (1). To facilitate the smooth retraction of said first (14), second (15*a*) and third (16*a*) pin when the key is removed, on both sides of said first (37) and second (38) said grooves, there exist respective curvoconcave reductions (39) whose transverse depth grows progressively greater toward said operative cross-section (10) of the swinging member (6).

To facilitate the removal of the key without the swinging member (6) causing any blockage, this swinging member (6) has a rear face of a symmetrically rounded profile which favors the retracting of the swinging member (6) toward the heart of the thickness of the key blade (1); and this, in spite of the limitation of the transverse rotation, makes it possible to ensure that this swinging member (6) will not extend more than is proper.

Figure 6:
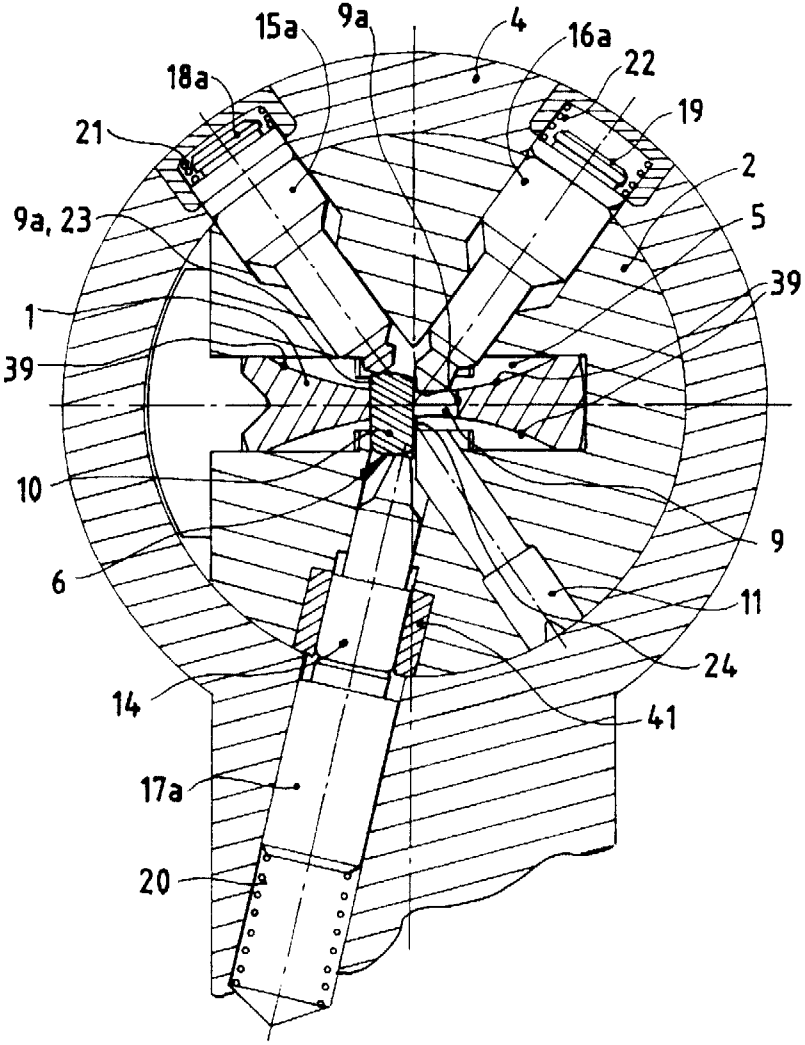
FIG. 6 is like FIG. 5, but with the correct key blade (1) having been introduced.
Figure 5:
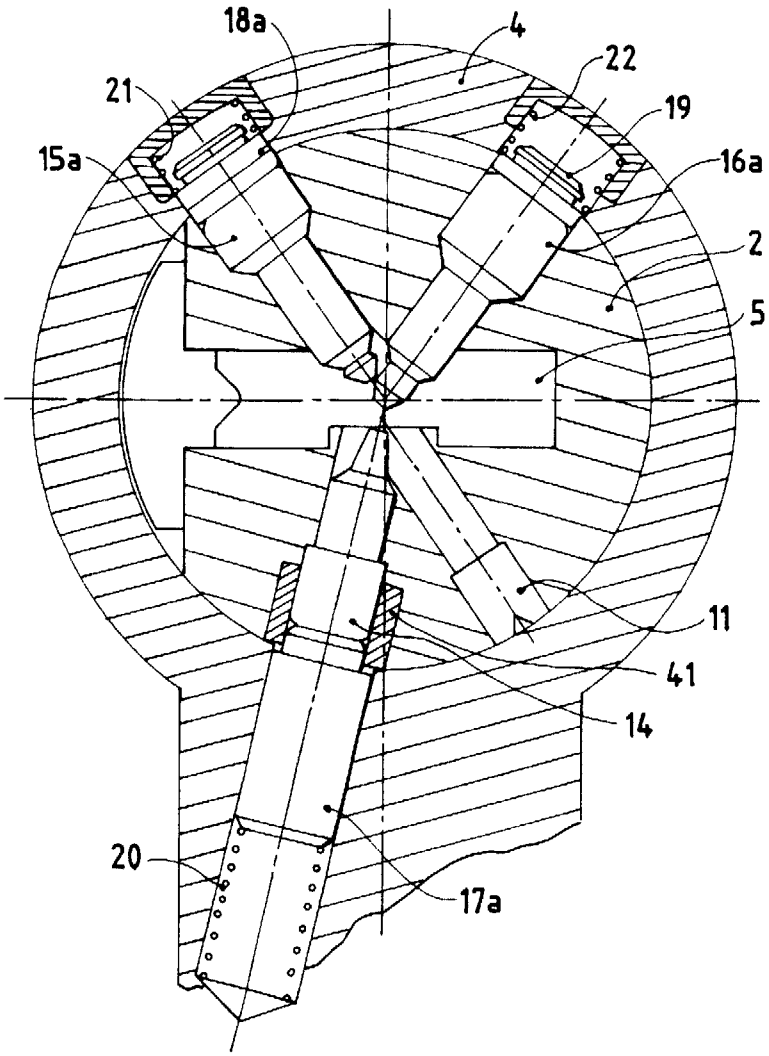
FIG. 5 is a cross-section of the rotary cylinder-retainer ring assembly (2–4) taken in the common plane passing through the axes of the shafts of the fixed pin (11) and the first (14), second (15*a*) and third (16*a*) movable pins, the key blade (1) being extracted; (this is an embodiment of the secondary code)

Comparing FIGS. 5 and 6, it is noted that the correct position of the swinging member (6) of the valid key determines risings of the first (14), second (15*a*) and third (16*a*) pin, until the first (17*a*), second (18*a*) and third (19) counterpins are properly withdrawn in the static body (4).

Comparing FIGS. 6 and 7, it can be appreciated that when (FIG. 7) the fixed pin (11) is not installed, there is produced a lateral action that caused the angular rotation, for which reason the swinging member (6) remains in a centered position in which only the first set of pin-counterpin (14, 17*a*) makes a code. Conversely, when (FIG. 6) said fixed pin (11) is (installed) and produces its lateral action, the second pin-counterpin set (15*a*, 18*a*) ascends until its makes a code and the third pin-counterpin set (16*a*, 19) descends until it also achieves said code position; then, there is already possible the first rotation of the rotary cylinder (2) to produce the opening of the closure.

In addition to the triple rotary closure provided by said pin-counterpin sets (14, 17*a*, 15*a*, 18*a*, 16*a*, 19), provision is made to install in the cylinder (2) a steel sleeve (410 in relation to said first pin (14)

In order that, during the insertion of the key, the swinging member may automatically start adopting the final work position through its two combined rotary movements, the invention comprises (FIGS. 14 to 18) a feature in which, with respect to the position of the non-rotated cylinder (2) into which the key is inserted in order to carry out the opening operation, said key channel (5) has upper (42) and lower (43) faces which, in said insertion of the key, come to rest, respectively, against said first (37) and second (38) grooves of said key blade (1); on which upper (42) and lower (43) faces of said key channel (5) there exist respective longitudinal upper (44) and lower (45) grooves which begin, respectively, from the front and rear faces of said cylinder (2) and which do not cover the full length of said key channel (5), for which reasons said upper (44) and lower (45) grooves overlap on a intermediate part of said key channel (5), where said upper (44) and lower (45) grooves define in said upper (42) and lower (43) faces of the key channel (5) respective upper (46) and lower (47) edges of intersection, and which lower groove (45), in an initial segment is uniformly widened into a lateral open area (48) which at its end within said cylinder (2) ends up as a bevel (49) which links up with a final segment of the lower groove (45) itself, which bevel (49) is immediately in front of the position of said swinging member (6), the key being fully inserted into said key channel (5). All of this so that, in the insertion of the key blade (1) three consecutive phase are distinguishable: a first phase, in which the said lower face (43) of the key channel (5) causes the swinging member (6), which by gravity is coming down, to butt against the second flange (29) (FIG. 19), to rise until it butts against the first flange (28), which takes place by virtue of the transverse rotary movement and being made possible by the penetration of the swinging member (6) into said upper groove (44), with the first horizontal side (25) sliding over the lower face (43); a second phase, in which, on the said upper edge (46) making contact with the swinging member (6) in the segment of overlapping with said lower groove (45), the swinging member (6) falls (FIG. 20), occupying the lower groove (45) and advances with its second horizontal side (26) sliding over the upper face (42) of the key channel (5); and a third phase, in which (the second side 26 remaining against the upper face 42), there is reached the lateral open space (48) which widens the lower groove (45) itself and then there is produced the contact of the swinging member (6) against the fixed pin (11) which, on being interposed in the path of the swinging member (6) exerts on the latter a lateral action which causes the swinging member (6) to deviate in its angular rotation until it butts against the corresponding radial sidewall (9*a*) of the sectorial window (9), this being possible because the swinging member can occupy the widening generated by said lateral open space (48).

On extracting the key, the bevel (49) leads the swinging member (6) smoothly and progressively toward the lower groove (45), where the swinging member (6) comes to butt against the lower edge (43) which causes the swinging member (6) to rise to the position shown in FIG. 19 and it can now effect inversely the run of the first phase of insertion.

The nature of the present invention, as well as its industrial embodiment, having been sufficiently described, it need only be added that in its whole and constituent parts, it is possible to introduce changes of form, material and layout into the content of the invention, to the degree that such alterations do not deviate from its basis.

I claim:

1. A rotating cylinder lock non-reproducible locking key comprising:

a key blade said key blade having a lock insertion end which enters a cylinder lock to allow said key to open and close said lock, an opening formed in said key blade adjacent said lock insertion end, said opening having a first end closer to said lock insertion end than an opening second end opposite said first end, said second end having an arcuate shape:

a swinging member mounted in said opening, said swinging member being mounted to pivot about a first axis and a second axis and said first axis extends perpendicular to said second axis, said swinging member has a first and a second side which are perpendicular to a plane of said key blade, and curvoconvex horizontal bottom and top walls, whereby when an opening code for a rotating cylinder lock is determined said first side is adapted to receive from a fixed pin of said lock a lateral position action that produces an angular rotation of said swinging member with respect to said second axis such that said second side rests against a radial sidewall of the opening.

2. A rotating cylinder lock non-reproducible locking key comprising:

a key blade, said key blade having a lock insertion and which enters a cylinder lock to allow said key to open and close said lock, an opening formed in said key blade adiacent said lock insertion end, said opening having an opening first end closer to said lock insertion end than an opening second end opposite said opening first end, said opening second end having an arcuate shape, a swinging member mounted on a shaft in said opening, said shaft is located closer to said opening first end than said opening second end, said shaft is mounted adjacent one end of said swinging member, said swinging member being mounted to pivot about a first axis and a second axis and said first axis extends perpendicular to said second axis;

the other end of said swinging member has a rear projection, said key including a pair of spaced first and second lips which jut from an arched opening end wall into the opening, whereby pivot movement of rotation of the swinging member about said shaft is limited by said projection butting against respective said first and second lips.

3. A rotating cylinder lock non-reproducible locking key comprising:

a key blade, said key blade having a lock insertion end which enters a cylinder lock to allow said key to open and close said lock, an opening formed in said key blade adjacent said lock insertion end, said opening having an opening first end closer to said lock insertion end than an opening second end opposite said opening first end, said opening second end having an arcuate shape, a swinging member mounted on a shaft in said opening, said shaft is located closer to said opening first end than said opening second end, said shaft is mounted adjacent one end of said swinging member, said swinging member being mounted to pivot about a first axis and a second axis and said first axis extends perpendicular to said second axis;

said one end of said swinging member has a front end face in which there exists a first groove of approximately vertical semi-elliptical shape which extends substantially parallel to said shaft, said first groove faces a second semi-circular groove formed in said opening first end, and said first and second grooves receiving between them a cylindrical cotter pin having a radius equal to that of said second groove.

4. A key, according to claim 2 wherein said other end of said swinging member has a rear face with a symmetrically rounded shape.

5. A key, according to claim 2, wherein said swinging member possesses simultaneously said rear transverse projection and a first semi-circular front groove.

6. A rotating cylinder lock non-reproducible locking key comprising:

a key blade, said key blade having a lock insertion end which enters a cylinder lock to allow said key to open and close said lock, an opening formed in said key blade adjacent said lock insertion end, said opening having an opening first end closer to said lock insertion end than an opening second end opposite said opening first end, said opening second end having an arcuate shape, a swinging member mounted on a shaft in said opening, said shaft is located closer to said opening first end than said opening second end, said shaft is mounted adjacent one end of said swinging member, said swinging member being mounted to pivot about a first axis and a second axis and said first axis extends perpendicular to said second axis;

said opening is made in a reduced thickness of said key blade, said reduced thickness is defined between two equal first and second longitudinal grooves beginning from the insertion end of the key blade.

7. A key according to claim 6, wherein said swinging member has an operative substantially rectangular cross-section and wherein in relation to said operative cross-section of the swinging member and along both sides of said first and second grooves, there exist respective curvoconcave reductions whose depth grows progressively toward said operative cross-section of the swinging member.

8. A rotating cylinder lock non-reproducible locking key comprising:

a key blade, said key blade having a lock insertion end which enters a cylinder lock to allow said key to open and close said lock, an opening formed in said key blade adjacent said lock insertion end, said opening having an opening first end closer to said lock insertion end than an opening second end opposite said opening first end, said opening second end having an arcuate shape, a swinging member mounted on a shaft in said opening, said shaft is located closer to said opening first end than said opening second end, said shaft is mounted adjacent one end of said swinging member, said swinging member being mounted to pivot about a first axis and a second axis and said first axis extends perpendicular to said second axis;

said shaft is a cylindrical shaft which is installed in an auxiliary orifice of a variable section of said swinging member, said auxiliary orifice is circular in its central section and widens ellipsoidally toward both outlets, said orifice keeping its diameter constant solely over the distance coincident with said second axis.

9. A key, according to claim 2, wherein said shaft is symmetrically convex and is installed in a cylindrical auxiliary orifice of said swinging member, said shaft having a central section in which the diameter coincides with the diameter of said cylindrical auxiliary orifice.

10. A system of a non-reproducible locking key and a rotatable cylinder lock for said key, said key having a flat key blade, said cylinder lock having a rotating cylinder rotatably mounted within a retaining body, said cylinder having an insertion channel adapted to accept said key blade and a plurality of radially disposed pins in circumferentially spaced relation to operate with said blade and counterpins that drive said pins and are capable of remaining precisely retracted in said retaining body when there is established a primary opening code, said key blade has side walls, a key blade plane parallel to said side walls, and a lock insertion end, the improvement comprising a window formed in said key blade adjacent said lock insertion end, said window passing through a thickness of said key blade, said window has an arcuate rear wall, a narrower front wall and lateral sidewalls diverging between said narrower front wall and said rear wall, a longitudinal swinging member mounted in said window, said swinging member has a first and second side wall, a top wall, a bottom wall, a front wall and a rear wall; a plane of said first side wall is transverse to the key blade plane, said swinging member is mounted to make two pivotal movements of limited amplitude, a first pivotal movement is a transverse pivot movement in a first plane that is perpendicular to said key blade plane, a second pivotal movement in a second plane that is parallel to said key blade plane, said first and second pivotal movements are produced about a swing member shaft, said shaft being in said key blade between said key blade side walls and having a shaft axis extending toward the top and bottom walls of said key blade and perpendicularly to a longitudinal axis of said key blade to provide a first swinging member pivotal axis coextensive with said shaft axis and a second swinging member pivotal axis perpendicular to said shaft axis;

said cylinder has a fixed pin and a plurality of movable pins, said movable pin are driven by corresponding counterpins, which can be precisely retracted in said retaining body against corresponding springs, respectively when there is established said opening code, wherein when said key blade is properly inserted in said cylinder and, said opening codes being correct, said fixed pin exerts contact on one of said swinging member side wall to provide an angular rotation of said swinging member with respect to said second pivotal axis until said swinging member comes to have its opposite sidewall resting against a respective portion of the window; said movable pins contacting said one swinging member side wall and at least one of said top and bottom walls of said swinging member.

11. The system according to the claim 10 wherein said swinging member has an operative substantially rectangular cross-section with respect to which there operates simultaneously a fixed pin and three sets of pin-counterpin locking means, said means including first, second and third movable pins which are driven by the respective first, second and third counterpins, said counterpins being precisely retractable in a retaining body for a rotating cylinder lock against respective first, second and third springs, whereby when said operative cross-section of said swinging member is engaged by said fixed pin and first, second and third movable pins, there is established an opening code.

12. A lock system according to claim 10, wherein said cylinder incorporates said fixed pin and a first, second and third movable pins to operate in a common plane; and which first, second and third movable pins are driven by corresponding first, second and third counterpins, which can be precisely retracted in said retaining body second and third springs, respectively, when there is established said opening code.

13. A lock system according to claim 12, wherein, when in a key channel of said cylinder there is properly inserted said key blade and said opening codes being correct, said fixed pin and first, second and third movable pins, acts simultaneously on an operative surface of the swinging member which is formed with an essentially rectangular cross-section shape that when said key blade is in horizontal position, said swinging member has first and second vertical sides, which are perpendicular to the plane of said key blade, and by horizontal top and bottom walls, all of them such that, when there is determined said opening code, said fixed pin exerts on said first vertical side a lateral positioning action that produces an angular rotation of said swinging member with respect to said second geometric axis until said swinging member comes to have its opposite or said second vertical side resting against a respective radial sidewall of the window; said first movable pin acts on said first horizontal side; and said second and third movable pins both act on said horizontal top wall.

14. A lock system according to claim 12, wherein, with respect to the position of the cylinder into which the key is inserted to carry out an opening action, said cylinder has a key channel with upper and lower faces which in said insertion of the key rest, respectively, against first and second grooves of said key blade; said upper and lower faces of said key channel have respective and lower longitudinal grooves which begin, respectively, at front and rear faces of said cylinder and each of said upper and lower grooves do not cover the entire length of said key channel to provide said upper and lower grooves overlap on an intermediate part of said key channel, where said upper and lower grooves define in said upper and lower faces of the key channel the respective upper and lower edges of intersection, and which said lower groove in an initial segments is widened uniformly according to a lateral open space which at its end within said cylinder is a bevel (49) which links up with a final segment of the lower groove (45) said bevel is immediately in front of the position of said swinging member, when said key is fully inserted into said key channel.

15. The lock system of claim 10 wherein said swinging member shaft is mounted adjacent said swinging member front wall, said swinging member front wall being closer to said key blade insertion end than said swinging rear wall.

16. The lock system of claim 15 wherein the rear wall of said swinging member has a rear projection, said key includes a pair of spaced first and second lips which jut from an arched window end wall into the window, whereby pivot movement of rotation of the swinging member about said shaft, is limited by said projection butting against respective said first and second lips.

17. The lock system of claim 15 wherein said front wall of said swinging member has a first groove of approximately vertical semi-elliptical shape which extends substantially parallel to said shaft, said first groove faces a second semi-circular groove formed in said front wall of said window, and said first and second grooves receiving between them a cylindrical cotter pin having a radius equal to that of said second groove.

18. The lock system of claim 17 wherein said rear wall of said swinging member has a symmetrically rounded shape.

19. The lock system of claim 18 wherein said swinging member possesses simultaneously said rear transverse projection and a first semi-circular front groove.

20. The lock system of claim 15 wherein said window is made in a reduced thickness of said key blade, said reduced thickness is defined between two equal first and second longitudinal grooves beginning from the insertion end of the key blade.

21. The lock system of claim 20 wherein said swinging member has an operative substantially rectangular cross-section and wherein in relation to said operative cross-section of the swinging member and along both sides of said first and second grooves, there exist respective curvoconcave reductions whose depth grows progressively toward said operative cross-section of the swinging member.

22. The lock system of claim 15 wherein said shaft is a cylindrical shaft which is installed in an auxiliary orifice of a variable section of said swinging member, said auxiliary orifice is circular in its central section and widens ellipsoidally toward both outlets, said orifice keeping its diameter constant solely over the distance coincident with said second axis.

23. The lock system of claim 15 wherein said shaft is symmetrically convex and is installed in a cylindrical auxiliary orifice of said swinging member, said shaft having a central section in which the diameter is maximum and coincides with the diameter of said cylindrical auxiliary orifice.

* * * * *